US006615832B1

(12) United States Patent
Chen

(10) Patent No.: US 6,615,832 B1
(45) Date of Patent: Sep. 9, 2003

(54) WEAR ARTICLE WITH DETACHABLE INTERFACE ASSEMBLY

(75) Inventor: David E. Chen, Walnut, CA (US)

(73) Assignee: Bragel International, Inc., Pomona, CA (US)

( * ) Notice: Subject to any disclaimer, the term of this patent is extended or adjusted under 35 U.S.C. 154(b) by 0 days.

(21) Appl. No.: 09/592,630

(22) Filed: Jun. 13, 2000

Related U.S. Application Data

(60) Provisional application No. 60/140,423, filed on Jun. 22, 1999.

(51) Int. Cl.[7] ..... A62B 18/08

(52) U.S. Cl. ..... 128/206.26; 128/205.25; 128/206.12; 128/206.21; 128/206.28

(58) Field of Search ..... 128/205.25, 206.12, 128/206.17, 206.19, 206.21, 206.24, 206.26, 206.28

(56) References Cited

U.S. PATENT DOCUMENTS

| | | | | | |
|---|---|---|---|---|---|
| 2,023,469 | A | | 12/1935 | Grier | 88/49 |
| 2,026,087 | A | | 12/1935 | Grier | 88/49 |
| 2,032,843 | A | | 3/1936 | Grier | 88/49 |
| 2,561,403 | A | | 7/1951 | Nelson | 88/48 |
| 4,500,179 | A | | 2/1985 | Schönhut | 351/137 |
| 4,543,950 | A | * | 10/1985 | Keys, Jr. | 128/203.29 |
| 4,907,584 | A | * | 3/1990 | McGinnis | 128/206.24 |
| 5,243,971 | A | * | 9/1993 | Sullivan et al. | 128/204.18 |
| 5,696,572 | A | | 12/1997 | Winkler | 351/137 |
| 5,771,087 | A | | 6/1998 | Martin et al. | 351/136 |
| 5,884,624 | A | * | 3/1999 | Barnett et al. | 128/206.24 |
| 5,918,598 | A | * | 7/1999 | Belfer et al. | 128/205.25 |
| 5,921,239 | A | * | 7/1999 | McCall et al. | 128/205.25 |
| 6,019,101 | A | | 2/2000 | Cotner et al. | 128/207 |
| 6,035,852 | A | * | 3/2000 | Hoftman | 128/206.21 |
| 6,112,746 | A | * | 9/2000 | Kwok et al. | 128/206.26 |
| 6,123,071 | A | * | 9/2000 | Berthon-Jones et al. | |
| 6,206,003 | B1 | * | 3/2001 | Burch | 128/206.21 |
| 6,357,441 | B1 | * | 3/2002 | Kwok et al. | 128/205.25 |

FOREIGN PATENT DOCUMENTS

| | | |
|---|---|---|
| CH | 656234 | 6/1986 |
| WO | WO85/05700 | 12/1985 |

* cited by examiner

*Primary Examiner*—Weilun Lo
*Assistant Examiner*—Darwin P. Erezo
(74) *Attorney, Agent, or Firm*—Christie, Parker & Hale, LLP

(57) ABSTRACT

A wear article including a body or shell formed from a structurally rigid material having a surface that is shaped to fit over a portion of a person's body. An interface flange is sized and shaped to mate with the body surface to form a releasible or removable attachment therebetween. An interface pad is permanently attached to the flange, wherein the flange is interposed between the body and interface pad. The pad includes a resilient film body that is filled with a gel material and a contact surface configured to conform to a portion of a person's body when placed thereagainst. Together, the interface flange and interface pad form an interface assembly that is releasibly attached to the body.

16 Claims, 6 Drawing Sheets

WEAR ARTICLE WITH DETACHABLE INTERFACE ASSEMBLY

This application claim the benefit of Provisional Application Ser. No. 60/140,423 filed Jun. 22, 1999.

FIELD OF THE INVENTION

This invention relates to articles that are temporarily worn over a portion of a person's body that have an interface made from a conformable material and, more particularly, to wear articles having a removable interface assembly comprising a gel pad.

BACKGROUND OF THE INVENTION

Articles that are made for temporary wear to protect a user from injury or from contact with an external object include those designed for placement over a portion of, or over the entire surface of, a users face, e.g., protective face masks, goggles, face shields and eye glasses. Articles are also made for temporary wear over a portion of a person's face for the purpose of administering something, e.g., a mask placed over a person's nose and/or mouth to administer oxygen or other gas to the wearer.

Such articles can also be designed to be placed over another portion of a person's body, such as a sports cup for men, shin guards, elbow guards and the like. In all instances the protective article makes use of some type of interface material, placed on the surface of the article touching the body, to make wearing the object more comfortable. In known applications, foam is used as the interface material and is placed along a surface of the article that is designed to be placed into contact with the wearer's body. Use of the foam material makes the article more comfortable to wear.

While foam is known for its ability to deform and conform readily to an adjacent surface, and thereby provide a good level of contact comfort when placed between a body surface and a rigid wear article, foam does not always provide a leak-tight fit. In certain applications, where it is important that a portion of a user's body be protected from contact by an external object, it is desired that the interface material provide not only a comfortable fit but one that is capable of forming a leak-tight seal. An example of such an application is an eye shield that is used in the field of medicine to protect the eyes of a medical professional from contact with the bodily fluids of a patient. Another example calling for a substantially leak-tight seal is with a mask placed over a person' nose and/or mouth for the administration of oxygen or other gas. The use of a foam interface material in such application does not provide a leak-tight seal.

Recent attempts to address the above-identified need have resulted in the use of alternative interface materials. U.S. Pat. No. 6,019,101 discloses a specialized nasal air mask comprising silicone-filled bladder interposed between a wearer's face and the mask. The silicone-filled bladder is permanently attached to the mask to provide a leak-tight seal therewith.

Currently, the above-described wear articles are constructed with the interface layer, whether in the form of a foam or silicone material, as a permanent part of the article. When the interface layer of these articles becomes worn or otherwise unusable, the entire article must be replaced. Additionally, while foam is used to provide some degree of comfort to the wearer, in certain applications foam is not always able to deform readily to provide a most comfortable fit. In fact, after repeated uses, foam loses a portion of its memory function and becomes progressively less able to deform as needed to continue providing a comfortable interface to the user.

It is, therefore, desirable that such wear articles comprise a new interface construction that: (1) provides superior comfort to and improved conformance with the user when compared to foam; (2) provides a leak-tight seal between the wear article and the user's body surface; and (3) is capable of being removably attached to the wear article to permit its economic replacement without having to replace the entire wear article.

SUMMARY OF THE INVENTION

This invention relates to wear articles comprising interface constructions of this invention that are positioned between the wear article and a portion of a person's body. Wear article s of this invention comprise a body or shell formed from a structurally rigid material and having a surface that is shaped to fit over a portion of a person's body. The body surface is configured comprising one or more attachment points.

An interface flange is sized and shaped to mate with the body surface. The flange surface includes one or more attachment points that are positioned along the flange surface to cooperate with respective body attachment points to form a releasible or removable attachment therebetween.

An interface pad is permanently attached to the flange, wherein the flange is interposed between the body and interface pad. The pad comprises a resilient film body that is filled with a gel material. The pad includes a contact surface that is configured to conform to a portion of a person's body when placed thereagainst. Together, the interface flange and interface pad form an interface assembly that is releasibly attached to the body.

The interface assembly provides an improved degree of comfort and conformance to a person wearing a wear article comprising the same when compared to convention interface materials formed from foam. Further, the interface assembly permits the reuse of a wear article, by simply removing and replacing the interface assembly when the interface pad becomes worn or otherwise unusable, without having to replace the entire wear article. Thereby, extending the service life of the wear article and eliminating unnecessary wear article replacement costs.

BRIEF DESCRIPTION OF THE DRAWINGS

These and other features, aspects, and advantages of the present invention will be more fully understood when considered with respect to the following detailed description, appended claims, and accompanying figures:

DETAILED DESCRIPTION

This invention comprises a wear article that is designed for placement over a portion of a user's body, and that comprises a removable interface assembly comprising an interface pad and an interface flange permanently attached to a surface of the interface pad and comprising means for removably attaching the interface pad with the wear article. Constructed in this manner, the interface assembly comprises an element, i.e., a interface pad comprising a gel material, that deforms against a user's skin to conform therewith and provide an improved degree of comfort and sealability, when compared to conventional foam padding. The interface assembly further comprises an element, i.e., the interface flange, that permits the interface pad to be readily removed and replaced from the wear article without having to discard the entire wear article. The invention is better described below with reference to example embodiments.

Figure 2:
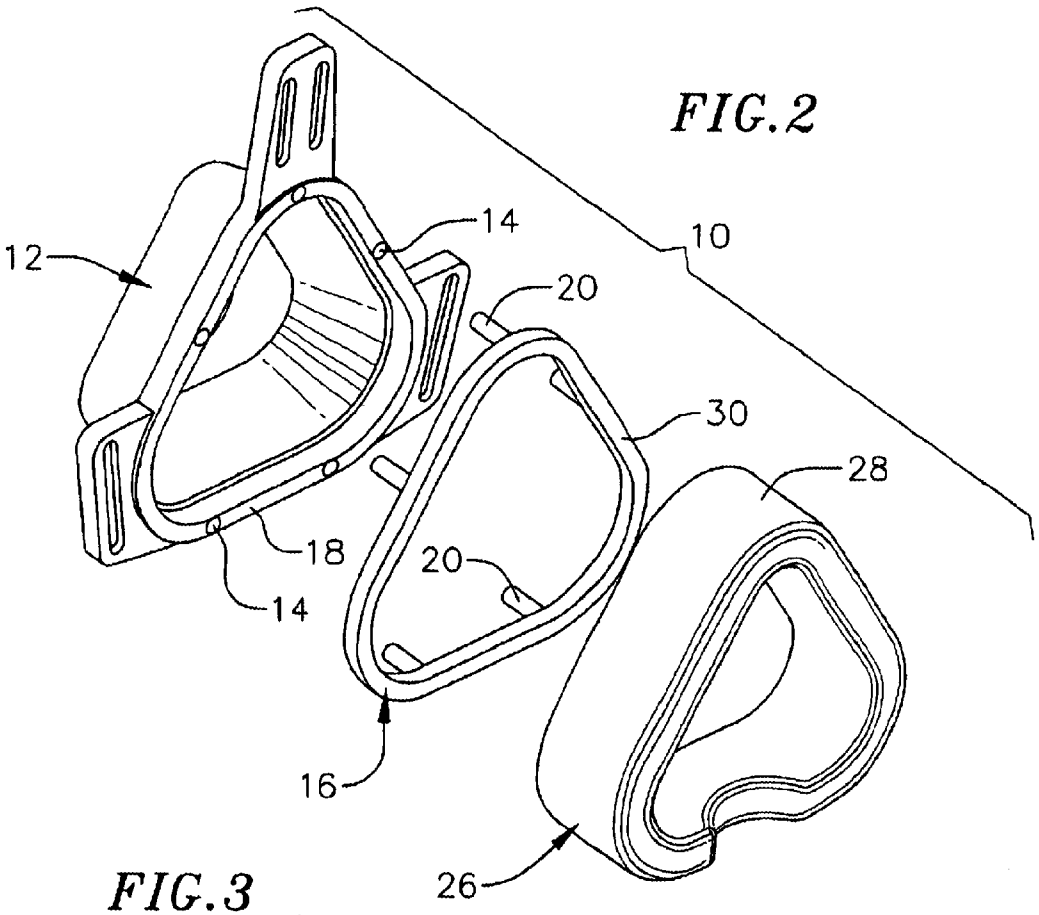
FIG. 2 is an exploded view of the nose and mouth mask of FIG. 1.
Figure 1:
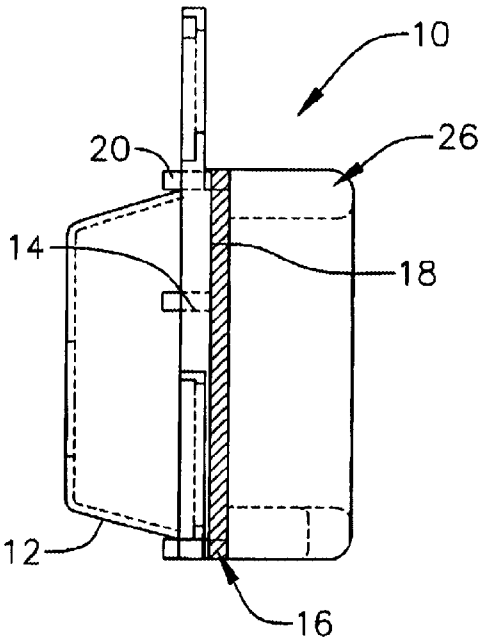
FIG. 1 is a cross-sectional side view of a nose and mouth mask constructed according to principles of this invention.

FIGS. 1 and 2 illustrate a nose and mouth mask 10 of this invention that can be used to either protect a person's nose and mouth from the surrounding environment, or to administer air or other gas to the mask wearer. The mask 10 comprises a generally hard shell 12 that is generally configured to be placed over a person's nose and mouth for purposes performing the mask's intended purpose.

The shell 12 includes attachment points 14 positioned along a contacting surface 18 that is located generally. adjacent a wearer's face. The attachment points 14 are configured to accept removable attachment with complementary attachment points 20 positioned along an opposed surface of an interface flange 16. The interface flange 16 is shaped to complement the shell surface 18 to permit attachment therewith. In an example embodiment, the interface flange 16 has a generally annular body that is configured geometrically to match the geometry of the shell surface 18. In this particular example, the shell surface and interface flange geometry is generally triangular. It is to be understood that the interface flange can be configured differently depending on the particular wear article and related shell configuration, e.g., having different two or three-dimensional shapes.

Figure 2A:
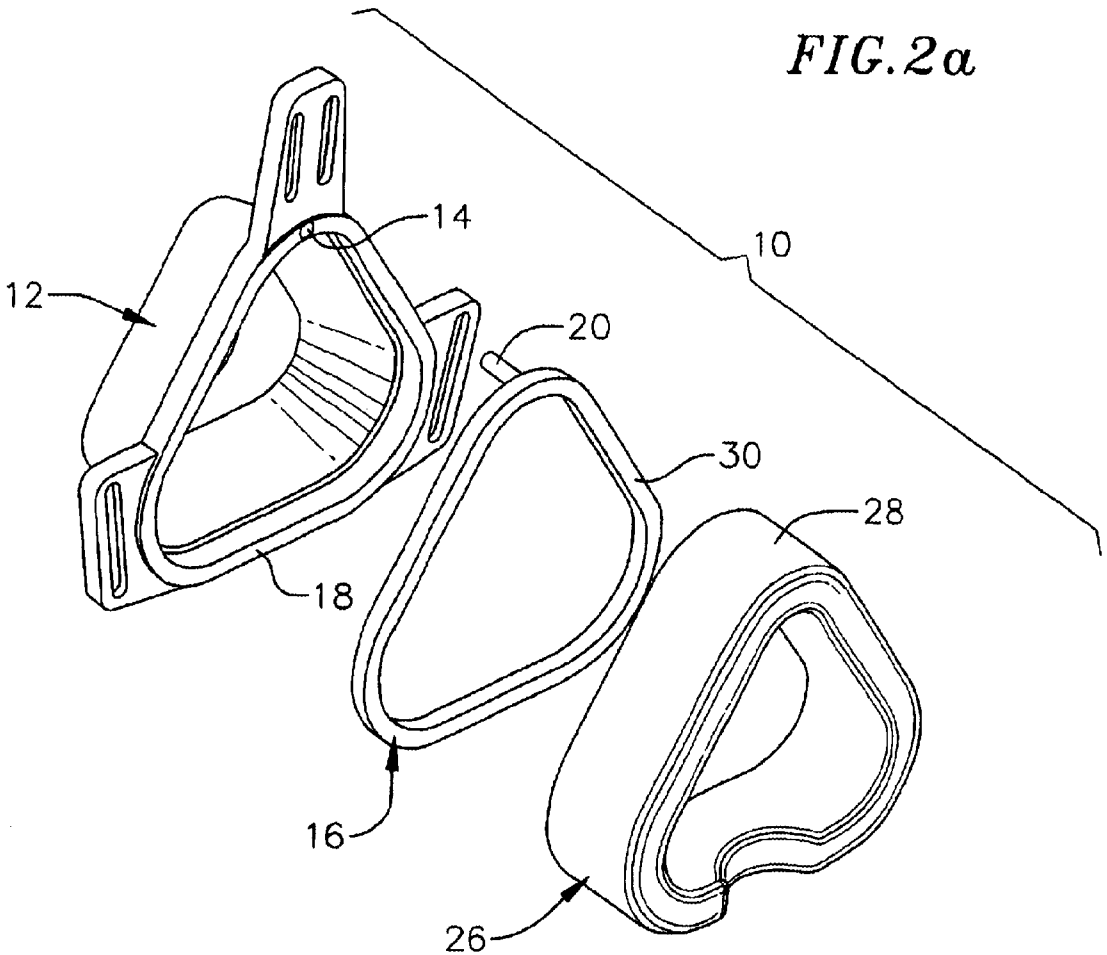
FIG. 2*a* is an exploded view of the nose and mouth mask of FIG. 1 showing one attachment point between the body and the interface flange.

The interface flange attachment points 20 are configured to provide an interlocking mechanical releasible attachment with the shell attachment points 14 when joined together. FIG. 2*a* shows an embodiment where one attachment point 20 of the interface flange is configured for releasible attachment with one attachment point 14 of the shell. Suitable attachment point configurations include those provided by complementary interlocking mechanical attachment mechanisms, e.g., snaps, buttons, and the like.

The interface flange attachment points 20 are configured to provide an interlocking mechanical releasible attachment with the shell attachment points 14 when joined together. Suitable attachment point configurations include those provided by complementary interlocking mechanical attachment mechanisms, e.g., snaps, buttons, and the like.

In an example embodiment, the interface flange attachment points 20 are in the form posts that each project outwardly away from an otherwise substantially planar surface of the interface flange. The shell attachment points 14 are in the form of openings sized to accommodate placement of respective posts therein. Each post comprises a head adjacent a distal post end that is sized slightly larger than the diameter of a respective opening. The post and/or opening is formed from a resilient material, such as plastic or the like, that will permit passage of the post head through the opening and restrict unintended removal of the post therefrom. The post head serves to keep the post secured within a respective opening until intentional removal by imposing sufficient pulling force thereon.

Figure 3:
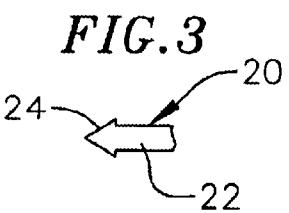
FIG. 3 is a cross-sectional side view of an attachment point from the nose and mouth mask of FIGS. 1 and 2.

FIG. 3 better illustrates each such post 20 as comprising includes a shaft portion 22, that has a constant diameter, and a head portion 24 that is shaped like an arrow having a tip and an outwardly flared section. Configured in this manner, each post 22 is received within a respective opening 14 and, by snapping action, the flared section provides a releasible lock therewith. The use of posts and opening have been described as but one type of complementary interface flange and shell attachment point. It is to be understood that other mechanical attachment configurations are possible and within the scope of the invention to provide a releasible attachment between the interface flange and shell.

An interface pad 26 comprises a resilient film body or bladder 28 that is filled with a suitable gel material, such as silicone, urethane and the like. The interface pad 26 is shaped to fit onto a surface 30 of the interface flange 16, along one of its surfaces, and is shaped on its other surface to accommodate placement against a portion of the user's body. The interface pad 26 is designed to be readily deformable when positioned against a user's body to conform thereagainst.

The interface pad 26 is permanently attached to the interface flange surface 30 by use of adhesive to provide a leak-tight seal therebetween. Together, the interface flange and interface pad form an interface assembly that is releasibly attached to the mask via cooperation between respective interface flange and shell attachment points. If desired, an adhesive (such as a pressure-sensitive adhesive) can be used between the adjoined surfaces of the interface flange and the shell to provide a leak-tight seal therebetween. Suitable adhesives include pressure-sensitive adhesives, and RTV silicone compounds that can be easily dejoined from the interface flange or shell surfaces to permit removal of the interface assembly. Configured in this manner, the interface assembly permits reuse of the mask after such time as the interface pad becomes used or otherwise unsuited for use, by simply removing and replacing the interface assembly. If an adhesive is desirably used, it can be applied to the adjacent shell or replacement interface assembly surface prior to reassembly.

Figure 5:
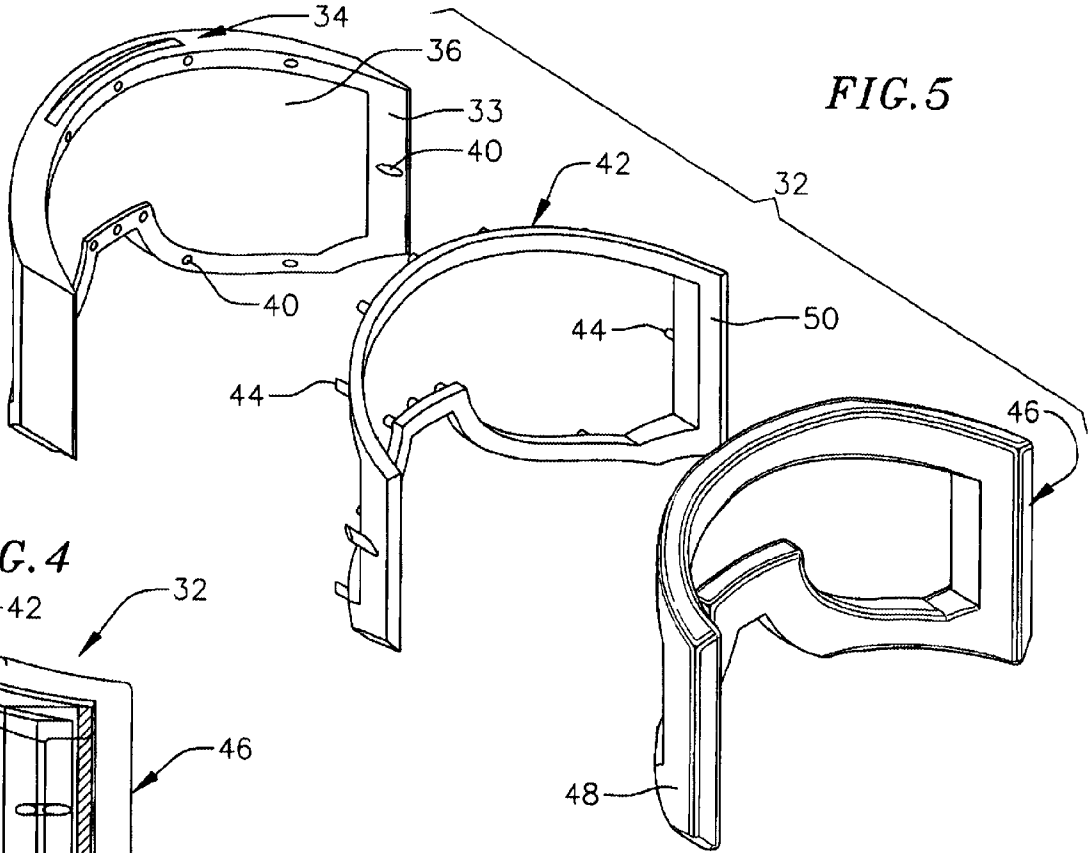
FIG. 5 is an exploded view of the eye shield of FIG. 4.
Figure 4:
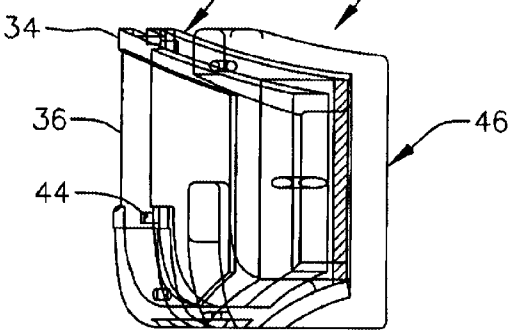
FIG. 4 is a cross-sectional side view of an eye shield constructed according to principles of this invention.

FIGS. 4 and 5 illustrate an eye shield 32, e.g., goggles, of this invention that can be used to protect a person's eyes from the surrounding environment. The shield 32 comprises a hard shell 34 that is generally configured in the manner necessary for the mask to perform its intended purpose. The hard shell 34 includes at least one lens 36, and a surface 38 for placement of the shell adjacent a wearer's face. The shell 34 includes a number of attachment points 40 positioned along the surface 38 for accepting removable attachment with complementary attachment points 44 of an interface flange 42. The interface flange 42 is constructed having a body shape that complements the shell surface 38 to permit placement against and attachment therewith. In an example embodiment, the interface flange 42 has a generally annular body that is configured to matches the shell surface 38.

The interface flange 42 includes attachment points 44 for forming a releasible attachment with the shell 34. As discussed above, in a preferred embodiment, the interface flange attachment points 44 are in the form posts that project outwardly away from the interface flange surface, and the shell attachment points 40 are in the form of post openings that are sized to receive and accommodate the posts. The particular configuration of the posts are illustrated in FIG. 3 and better described above.

An interface pad 46 comprises a resilient film body surface 48 that is filled with a suitable gel material, such as silicone, urethane and the like. The interface pad 46 is sized and shaped to fit onto a surface 50 of the interface flange, along one of the pad surfaces, and is shaped on its other surface to accommodate placement against a portion of the user's body and readily deform to conform to the body surface when placed thereagainst.

The interface pad 46 is permanently attached to the adapter surface 50 in the same manner as described above for the mask device illustrated in FIGS. 1 and 2. The attached interface pad and interface flange form an interface assembly that is removably attached to the shell to facilitate its easy removal and replacement to permit reuse of the eye shield or goggle should the interface pad become worn or otherwise unusable.

Figure 7:
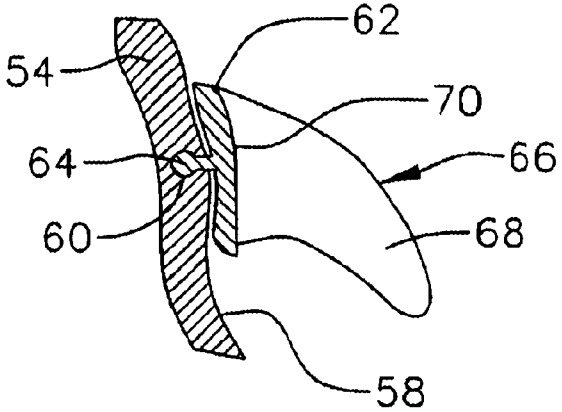
FIG. 7 is a cross-sectional side view of section 7—7 of FIG. 6.
Figure 6:
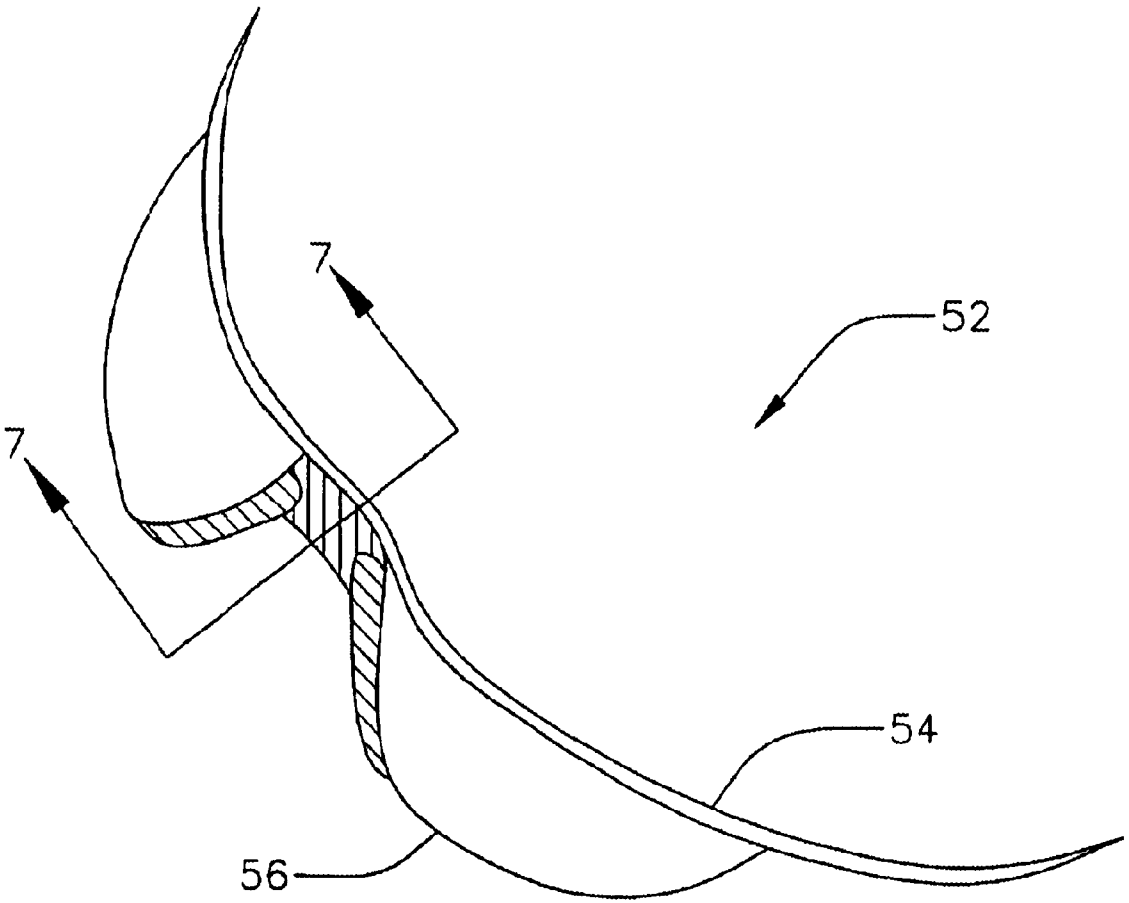
FIG. 6 is a schematic view of a pair of glasses constructed according to principles of this invention.

FIG. 6 illustrates a pair of eyeglasses 32 of this invention that are used to correct vision and/or protect one eyes generally and/or against the rays of the sun, i.e., sunglasses. The eyeglasses 32 comprise a hard frame shell 54 that is generally configured in the manner necessary for the eyeglasses to perform its intended purpose. The hard shell 54 includes at least one lens 56, and referring to FIG. 7, a surface 58 for placement adjacent a wearer's face. The surface 58 can either be disposed along a brim portion of the eyeglass frame, or can be defined along a nose piece section of the frame. The frame shell 54 includes one or more attachment points 60 disposed along the surface 58 for accepting removable attachment with an interface flange 62. The interface flange 62 is constructed, as disclosed above with reference to the device embodiments illustrated in FIGS. 1, 2, 4 and 5, having a body that is sized and shaped to complement the shell surface 58 to permit attachment therewith.

The interface flange 62 includes one or more attachment points 64 that cooperate with the shell attachment points 60 for forming a releasible attachment with the shell 43. As discussed above, in a preferred embodiment, the interface flange attachment points 64 are in the form of posts that project outwardly away from the flange surface, and the shell attachment points 60 are in the form of post openings that are disposed along the shell surface and that are sized to receive and accommodate the posts. The configuration of the posts are illustrated in FIG. 3 and better described above.

An interface pad 66 comprises a resilient film body surface 68 that is filled with a suitable gel material, such as silicone, urethane and the like. The interface pad 66 is sized and shaped to fit onto a surface 70 of the interface flange 62, along one of the pad surfaces, and is sized and shaped on its other surface to accommodate placement against a portion of the user's body to readily deform and conform with the body surface when placed thereagainst. The interface pad 66 is permanently attached to the interface flange surface 70 in the manner described above by use of adhesive so that the interface flange and interface pad together form an interface assembly that can be releasibly attached to the eyeglasses for easy removal and replacement should the interface pad become unusable.

Figure 9:
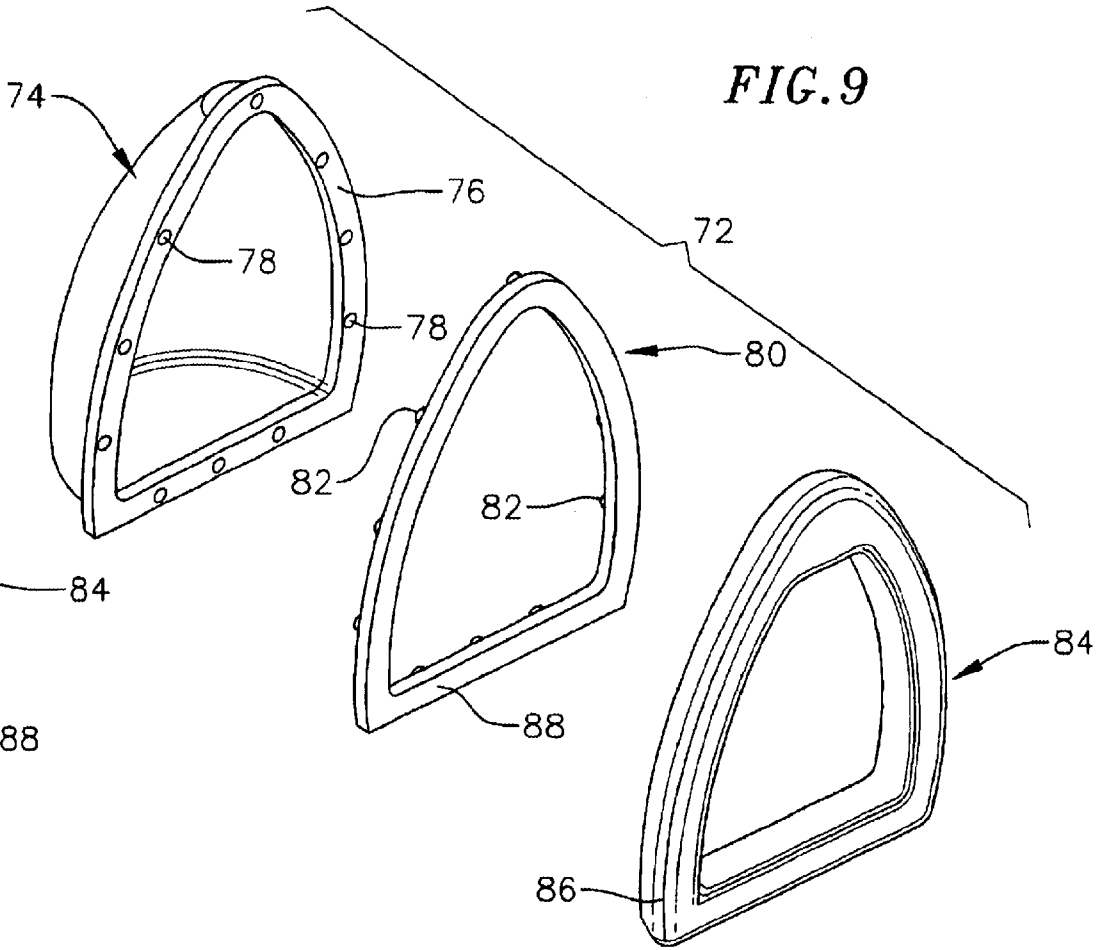
FIG. 9 is an exploded view of the sports protector of FIG. 8.
Figure 8:
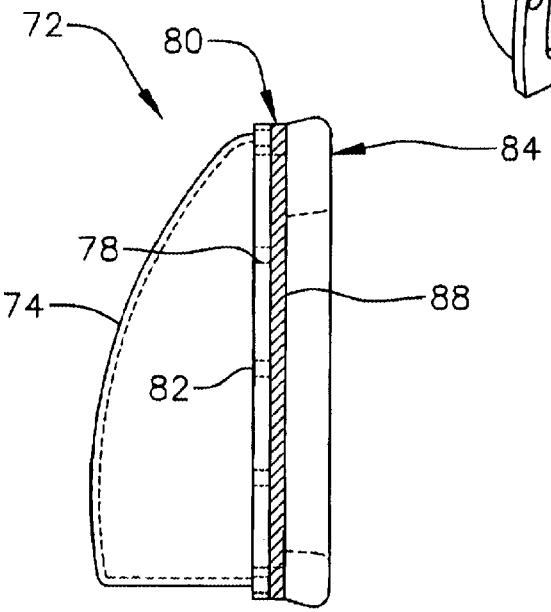
FIG. 8 is a cross-sectional side view of a mens sports protector constructed according to principles of this invention.

FIGS. 8 and 9 illustrate a mens sport protector or cup 72 of this invention that is used to protect the male groin from injury, e.g., during participation in sporting events. The cup 72 comprises a hard shell 74 that is generally configured in the manner necessary for the cup to perform its intended purpose. The hard shell 74 includes a surface 76 for placement adjacent a wearer's body. The shell 74 includes a number of attachment points 78 along the surface 76 for accepting removable attachment with an interface flange 80. The interface flange 80 is constructed having a body that is sized and shaped to complement the shell surface 76 to permit attachment therewith. In an example embodiment, the interface flange 80 has a generally annular body that is configured to match the shell surface 76.

The interface flange 80 includes attachment points 82 for forming a releasible attachment with the shell 74. As discussed above, in a preferred embodiment, the interface flange attachment points 82 are in the form attachment posts that project outwardly away from the interface flange surface, and the shell attachment points 78 are in the form of post openings that are sized and positioned to receive and accommodate the posts. The configuration of the posts are illustrated in FIG. 3 and better described above.

An interface pad 84 comprises an annular resilient film body 86 that is filled with a suitable gel material, such as silicone, urethane and the like. The interface pad 84 is sized and shaped to fit onto a surface 88 of the interface flange, along one of the pad surfaces, and is shaped on its other surface to accommodate placement against a portion of the user's body to readily deform and conform with the body surface when placed thereagainst. The interface pad 84 is permanently attached to the interface flange surface 88 by use of adhesive, thereby forming an interface assembly for removable attachment with the cup shell. Configured in this manner, the cup device can be reused when the interface pad becomes unusable by simply removing and replacing the interface assembly.

As generally described above, the interface pads that are used to form interface assemblies comprise a outer resilient or plastic film body that is filled with a suitable gel material. The interface pad can comprise a single bladder arrangement, in which the gel material is simply encapsulated by the outer resilient film that forms a containment bladder. Alternatively, the interface pad can comprise more than one bladder containing more than one material.

Figure 10:
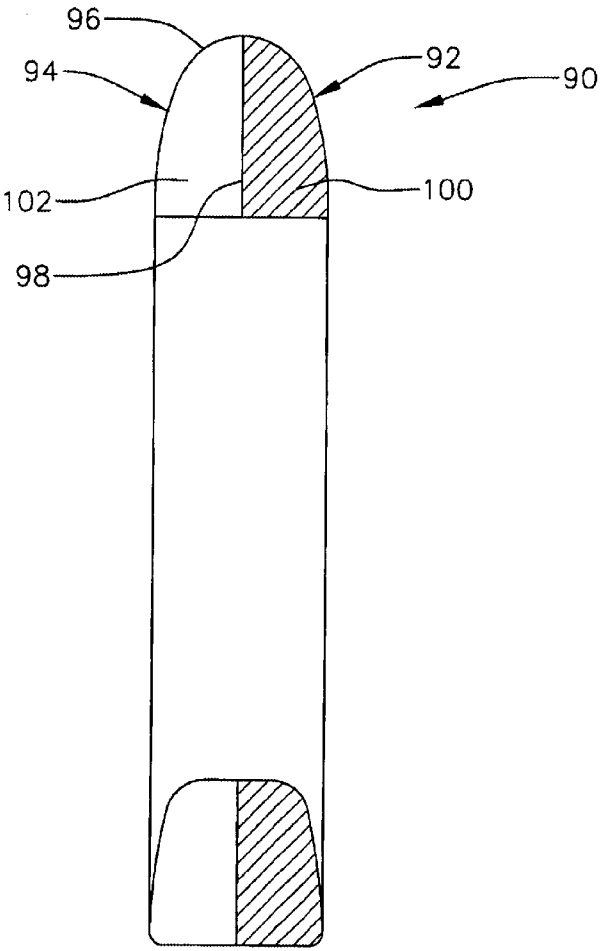
FIG. 10 is a cross-sectional side view of a interface pad of this invention comprising more than one chamber.

FIG. 10 illustrates an interface pad embodiment 90, that can be used to form interface flanges of this invention, comprising two separate chambers 92 and 94 defined by a common surrounding outside resilient film 96, and separated by a common dividing film separator 98. Each interface pad chamber 92 and 94 can be filled with desired different gel materials, gas materials, or one chamber can be filled with a gel material and the other chamber with a gas. In an example embodiment, interface pad chamber 92 is filled with a silicone gel 100, and interface pad chamber 102 is filled with a gas 102, e.g., air. In such example interface pad embodiment, the interface pad chamber 92 filled with gel material is the one that will make contact against a surface of a user's body to provide a desired degree of deformation to conform with the body surface. The interface pad chamber 94 filled with air is positioned adjacent the interface flange to buffer the interface chamber from the relatively rigid flange material, thereby providing an improved amount of wearing comfort to the user.

Additionally, there can be interface pad embodiments that comprise more than one gel or air chamber in any combination, e.g., air-gel-gel, gel-gel-air, gel-air-gel, gel-gel-gel, and air-gel-air, where each gel or air chamber in a particular construction can be the same or different. For example, a construction comprising two or more gel chambers can include a first gel that is relatively softer or harder than a second gel.

The different interface pad chambers can be filled with air or gel in a single thermo-forming process. The chambers can be formed from any kind of thermoplastic film, such as polyurethane, polyethylene, polycarbonate, or polypropylene, of various thickness and softnesses depending on particular application. An exemplary thermoplastic film is polyurethane having a thickness in the range of from about ½ to 3 mils.

Interface pads can be manufactured by techniques as described in U.S. Pat. No. 5,693,164. Other manufacturing techniques which can obtain a good welded seal of the outer film body and/or between layers of thermoplastic film may also be employed. All that is needed for constructing a multi-chamber interface pad embodiment is that the films be capable of being welded for enclosing the air and/or gel(s), and be substantially impervious to the air and/or gel(s). Preferably the film is selected so that the gel bonds to the film upon curing of the gel. Polyurethane film is preferred since it is amongst the toughest thermoplastic films available and is best able to stand the wear and abuse a person may give an article to be worn. It also bonds readily to the preferred silicone gels.

Although a silicone gel is preferred for forming interface pads, other gel materials may be used such as hydro gel, PVC gel, or polyurethane gel. In some embodiments, these gel materials may be preferred since they are less costly than silicone gel.

Use of the interface pad is preferred for contact with the body surface of a person wearing the article since it is capable of being made extremely soft and compliant, much softer than elastomers. Furthermore, it is not absorbent, as a foam material is. The greatest comfort is obtained with an extremely soft gel, however, somewhat stiffer gels may be used where there is not continuous contact with the skin or the contact is relatively gentle. Adjustment of the stiffness of the gel is readily controlled by mixing a non-reactive silicone oil with the gel precursor and varying the proportion and properties of the oil used.

Although the soft gel readily conforms to a person's skin, it is desirable to obtain greater conformance in some circumstances, and therefore the body of air is included in the combination. The body of air can yield for conforming to the surface of the person against which the article is worn. Being fluid it can provide greater accommodation than the gel. Furthermore, by using a gas, means can be provided (not shown) for adding or releasing gas from the contained pocket of gas to change the hardness of the combination and its ability to conform to an irregular surface. A suitable means for inflating or deflating such a pocket of gas is similar to the means currently employed for inflating and deflating the air pockets in various brands of inflatable footwear.

In the illustrated embodiment of glasses and goggles, the interface assembly can be constructed comprising a dual-chamber interface pad comprising a layer of soft gel is adjacent to the face of the wearer and the layer of air is between the soft gel and the relatively rigid interface frame. This arrangement may be reversed if preferred. In addition, one may employ multiple layers of gel and/or gas and the hardness of the gel in different layers may be varied as desired to obtain a required conformance to the surface of the user.

Such an arrangement of soft gel and cushion of air inside of a relatively rigid (but flexible) frame is particularly advantageous in goggles or masks used for skiing or diving. The combination of soft gel and cushion of air makes the surface of the goggles fit closely against the skin of the wearer. A somewhat high pressure of air may be used in diving goggles, for example, so as to assure a water-tight seal. Somewhat lower pressure of air may be used for goggles used for skiing or medical masks where a less tight fit is required.

A feature of wear articles of this invention is the use of the interface assembly comprising an interface pad to provide an improved degree of conformance and comfort to a user wearing the article when compared to conventional wear articles comprising a foam interface. A further feature of wear articles of this invention is the use of a removably attached interface assembly that both provides the use of an improved conformance interface pad user interface, and facilitates continued use of the wear article should the interface pad become worn or otherwise unusable, thereby avoiding the need to replace the relatively more costly wear article. Thus, the interface assembly of this invention operates to maximize the service life of the wear article.

It is to be understood that interface assemblies of this invention can be used in applications different than those described above and illustrated. For example, interface assemblies of this invention can be configured for use with footwear to protect a person's feet from the relatively hard surface of a show, with an earpiece or receiver of a telephone or headphone and the like to benefit from the enhanced conformity and comfort provided by such device. Interface assemblies of this invention can also be configured as a seat for vehicles such as bicycles and the like to also take advantage of the enhanced conformity and comfort provided by such device. Another such use could be within helmets used for cycling, motorcycle riding or vehicle racing. Presently, the interior of such helmets are often lined with a crushable foam and a softer foam or elastomer. These are difficult to make comfortable and very often there is an internal support structure or gaps between a portion of the helmet and the head of the user. These are but a few examples of other applications where a user or wearer of the otherwise hard article could benefit from placement of the interface assembly therebetween.

Accordingly, it is to be understood that, within the scope of the appended claims, wear articles constructed according to principles of this invention comprising an interface assembly may be embodied other than as specifically described herein.

What is claimed is:

1. A wear article for placement against a portion of a person's body comprising:

a body formed from a structurally rigid material and having a surface that is shaped to fit over a portion of a person's body, the body surface comprising one or more attachment points;

an interface flange having a surface designed to mate with the body surface, the flange surface comprising one or more attachment points that are positioned along the flange surface to cooperate with respective body attachment points to form a releasible attachment therebetween;

an interface pad permanently attached at one surface to the flange, wherein the flange is interposed between the body and interface pad, the interface pad comprising a resilient film body filled with a gel material, the interface pad including a contact surface that is configured to conform against a person's body portion when placed thereagainst;

wherein the interface flange and interface pad together form an interface assembly that is releasibly attached to the body;

wherein the interface pad comprises two or more separate chambers that are filled with a gel or gas material; and wherein the interface pad comprises two separate chambers, a first chamber positioned adjacent the interface flange filled with air, and a second chamber positioned for contact against a portion of a person's body filled with a gel material.

2. A wear article as recited in claim 1 wherein the body attachment points comprise a number of openings, and the interface flange attachment points comprise a number of posts that project from the flange surface and that are releasibly retained within respective attachment openings.

3. A wear article as recited in claim 2 wherein the posts each include a head portion that is sized slightly larger in diameter than the openings to be releasibly retained therein and removed therefrom with sufficient force.

4. A wear article as recited in claim 1 wherein the gel material used to fill the interface pad is a silicone compound.

5. A wear article as recited in claim 1 further comprising a pressure-sensitive adhesive interposed between the body and the interface flange.

6. A wear article as recited in claim 1 wherein the body is a mask configured to fit over one or both of the nose and mouth of a person, and wherein the interface pad is configured to fit over one or both of a person's nose and mouth to provide a leak-tight seal thereagainst.

7. A wear article for placement against a portion of a person's body comprising:

a body formed from a structurally rigid material, the body including an interface surface that is configured to fit against portion of a person's body, the interface surface comprising a number of attachment openings disposed therealong;

an interface flange having a flange surface sized and shaped to complement the body interface surface, the flange surface comprising a number of attachment posts that each project outwardly a distance from the flange surface and that are disposed within respective attachment openings, the posts having a head that is sized slightly larger than the attachment opening diameter for retainment therein, wherein one or both of the post and opening is sufficiently elastic to permit removal of the post from a respective opening by sufficient force to provide a releasible attachment therewith; and an interface pad permanently attached at one surface to the interface flange forming a releasible interface assembly, the pad comprising a resilient film body filled with silicone gel and having a contact surface that is configured to conform against a person's body portion when placed thereagainst;

wherein the interface pad comprises two or more separate chambers that are filled with a gel or gas material; and wherein the interface pad comprises two separate chambers, a first chamber filled with air and that is positioned adjacent the interface flange, and a second chamber filled with a gel material and that is positioned to conform against a portion of a person's body.

8. A wear article as recited in claim 7 further comprising a pressure-sensitive adhesive interposed between the body and the interface flange.

9. A wear article as recited in claim 7 wherein the body is a mask configured to fit over one or both of the nose and mouth of a person, and wherein the interface pad has an annular shape configured to provide a conforming leak-tight seal over one or both of a person's nose and mouth.

10. A nasal mask comprising:

a mask body formed from a structurally rigid material and configured to fit over a person's nose and mouth, the body including an interface surface that is positioned for placement around a person's nose and mouth, the interface surface comprising attachment points positioned therealong;

an interface flange having a flange surface sized and shaped to complement the body interface surface, the flange surface comprising attachment points that complement and cooperate with the body interface surface attachment points to provide a releasible attachment therewith; and an interface pad permanently attached at one of its surfaces to the interface flange forming an interface assembly, the pad comprising a resilient film body filled with silicone gel and configured to conform with a portion of a person's face when placed thereagainst;

wherein the interface assembly is releasibly attached to the mask body;

wherein the interface pad comprises two or more separate chambers that are filled with a gel or gas material; and wherein the interface pad comprises two separate chambers, a first chamber filled with air and that is positioned adjacent the interface flange, and a second chamber filled with a gel material and that, is positioned to conform against a portion of a person's body.

11. The nasal mask as recited in claim 10 wherein the mask attachment points comprise a number of attachment openings, and the flange attachment points comprising a number of attachment posts that each project outwardly a distance from the flange surface and that are disposed within respective attachment openings.

12. The nasal mask as recited in claim 11 wherein the attachment posts each have a head that is sized slightly larger than the attachment opening diameter for retainment therein, wherein one or both of the attachment post and attachment opening is sufficiently elastic to permit removal of the attachment post from a respective attachment opening by sufficient force to provide a releasible attachment therewith.

13. The nasal mask as recited in claim 10 wherein the gel material used to fill the interface pad is a silicone compound.

14. A removable interface assembly for use with wear article and that is interposed between the wear article and a portion of a person's body, the interface assembly comprising:

an interface flange having a flange surface that is configured to complement a mating surface of a wear article, the flange surface including attachment points that are configured to cooperate with attachment points disposed along the mating surface of the wear article to provide a removable attachment therewith; and an interface pad comprising a resilient film body that is filled with a gel material and that is permanently attached to the interface flange, the interface pad having a contact surface that is configured to make conforming contact with a portion of a person's body;

wherein the interface flange and interface pad together form an interface assembly for removable attached with a wear article;

wherein the interface pad comprises two or more separate chambers that are filled with a gel or gas material; and wherein the interface pad comprises two separate chambers, a first chamber filled with air and that is positioned adjacent the interface flange, and a second chamber filled with a gel material and that is positioned to conform against a portion of a person's body.

15. The assembly as recited in claim 14 wherein the flange attachment points are in the form of posts that project away from the flange surface, and the wear article surface comprises attachment points in the form of openings sized to accommodate removable placement of respective posts therein.

16. The assembly as recited in claim 15 wherein the posts each have a head that is sized slightly larger than the openings to facilitate retaining placement therein.

* * * * *